US005265382A

United States Patent [19]

Park

[11] Patent Number: 5,265,382

[45] Date of Patent: Nov. 30, 1993

[54] GLASS PLATE CHAMFERING MACHINE CAPABLE OF CHAMFERING AND GRINDING SUCCESSIVELY

[76] Inventor: Kyung Park, 305-1109 Jugong Apt. 670, Diachi-Dong, Kangnam-Ku, Seoul, Rep. of Korea

[21] Appl. No.: 992,138

[22] Filed: Dec. 17, 1992

[30] Foreign Application Priority Data

Jan. 21, 1992 [KR] Rep. of Korea ..... 804/1992

[51] Int. Cl.[5] ..... B24B 9/08; B24B 57/00

[52] U.S. Cl. ..... 51/283 E; 51/267; 51/270

[58] Field of Search ..... 51/283 E, 284 E, 106 R, 51/104, 267, 270

[56] References Cited

U.S. PATENT DOCUMENTS

| | | | |
|---|---|---|---|
| 3,148,488 | 9/1964 | Reaser | 51/267 |
| 4,733,999 | 3/1989 | Kitamura | 51/267 |
| 4,989,373 | 2/1991 | Park | 51/283 E |
| 5,028,182 | 7/1991 | Park | 51/235 |
| 5,074,079 | 12/1991 | Park | 51/165.77 |
| 5,078,256 | 1/1992 | Hatano et al. | 51/270 |

FOREIGN PATENT DOCUMENTS

| | | | |
|---|---|---|---|
| 2913672 | 10/1980 | Fed. Rep. of Germany | 51/270 |
| 1484624 | 6/1989 | U.S.S.R. | 51/283 E |

*Primary Examiner*—Robert A. Rose

*Attorney, Agent, or Firm*—Palmatier, Sjoquist & Helget

[57] ABSTRACT

A glass plate chamfering machine capable of chamfering and grinding successively is disclosed. An inverter adjusts the revolution speed of a wheel motor upon shifting the operating mode. A pressure air spout array is installed around the wheel motor to remove the chamfering fluid, the grinding fluid and glass particles. A chamfering fluid tank and a grinding fluid tank are installed on the bottom of the chamfering machine, with a chambering fluid circulating pump and a grinding fluid circulating pump being installed upon the two tanks respectively. A fluid guiding vessel is installed below the wheel motor, and a recovery hose is installed in such a manner as to be connected to either the chamfering fluid tank or to the grinding fluid tank.

4 Claims, 7 Drawing Sheets

GLASS PLATE CHAMFERING MACHINE CAPABLE OF CHAMFERING AND GRINDING SUCCESSIVELY

FIELD OF THE INVENTION

The present invention relates to a glass plate chamfering machine in which first a glass plate is chamfered, and then, can be ground only by replacing a grinding wheel on the chamfering machine, without transferring the glass plate to a separate grinding machine.

BACKGROUND OF THE INVENTION

The conventional chamfering machine is capable of removing the sharp edges of glass plates of various contours to an inclined or flat form. The chamfering work (machining or grinding) is carried out by performing a coarse chamfering, a medium coarse chamfering and a fine chamfering in the cited order. The chamfering tool consists of a diamond wheel, and the chamfering work is carried out by rotating the diamond wheel at 4500 rpm using a chamfering fluid or a cooling fluid.

When the chamfering work is completed, the chamfered surface is not smooth, and therefore, the glass plate is transferred to a separate grinding machine to be grounded by it. The grounding machine is very similar to the chamfering machine in its shape, constitution and working method, except in that the grinding machine uses a grinding wheel made of wool or synthetic resin. Further, the grinding machine uses a grinding fluid consisting of aqueous cerium oxide, while the revolution speed of the grinding wheel is about 2000 rpm.

Thus the working conditions for the chamfering and grinding are different from each other, and therefore, a separate grinding machine for meeting the above working conditions has been used in producing glass plates.

SUMMARY OF THE INVENTION

The present invention is intended to overcome the above described disadvantages of the conventional techniques by eliminating the necessity of using a separate grinding machine.

Therefore it is the object of the present invention to provide a glass plate chamfering machine which is capable of chamfering and grinding, the grinding being made possible only by replacing a grinding wheel in the same chamfering machine. Thus the facility cost is reduced, and the productivity is improved.

The technical conditions which are to be met to achieve the above object are as follows. That is, the revolution speed of a wheel motor has to be properly adjusted, and the fine glass particles which remain after the chamfering have to be cleanly removed, before initiating the grinding. If the fine glass particles are not completely removed, they will cause scratches on the glass plate during the grinding, thereby producing defective products.

Another condition to be met is that the chamfering fluid and the grinding fluid should not be mixed to each other. If the two kinds of fluids are mixed together, glass particles will be mixed into the grinding fluid, resulting that the glass particles will cause scratches on the glass plate during the grinding, thereby producing defective products. Further, if the two kinds of the fluids are mixed together, the grinding work cannot be properly carried out, because the two kinds of the fluids are composed of different compositions. Therefore, each time a glass plate is chamfered and ground, the chamfering fluid and the grinding fluid have to be completely replaced with new ones.

Therefore, in meeting the above technical conditions, the following measures are taken.

First, the revolution speed of the wheel motor is controlled by providing an inverter (frequency-shifting speed adjusting device) to shift the revolution speed of the wheel motor from 2000 rpm to 4500 rpm, or vice versa.

Second, a semi-circular pressure air spout array is installed around the wheel motor, thereby effectively cleaning the chamfering fluid, the grinding fluid and glass particles from the glass plate.

Third, a chamfering fluid tank and a grinding fluid tank are separately installed on the bottom of the chamfering machine, with a circulating pump being installed on each of them. The tubes of these chamfering fluid tank and the grinding fluid tank are led to injecting nozzles which are disposed near the wheel motor.

Fourth, a fluid guiding vessel is installed on the bottom of the wheel motor, and a drain tube is installed below the fluid guiding vessel, while the drain tube can be arbitrarily connected to either the chamfering fluid tank and or the grinding fluid tank.

By the above arrangements, a chamfering and a grinding can be performed within a single machine, thereby excluding the need for a separate grinding machine, and excluding the need for transferring the glass plates to a separate grinding machine.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
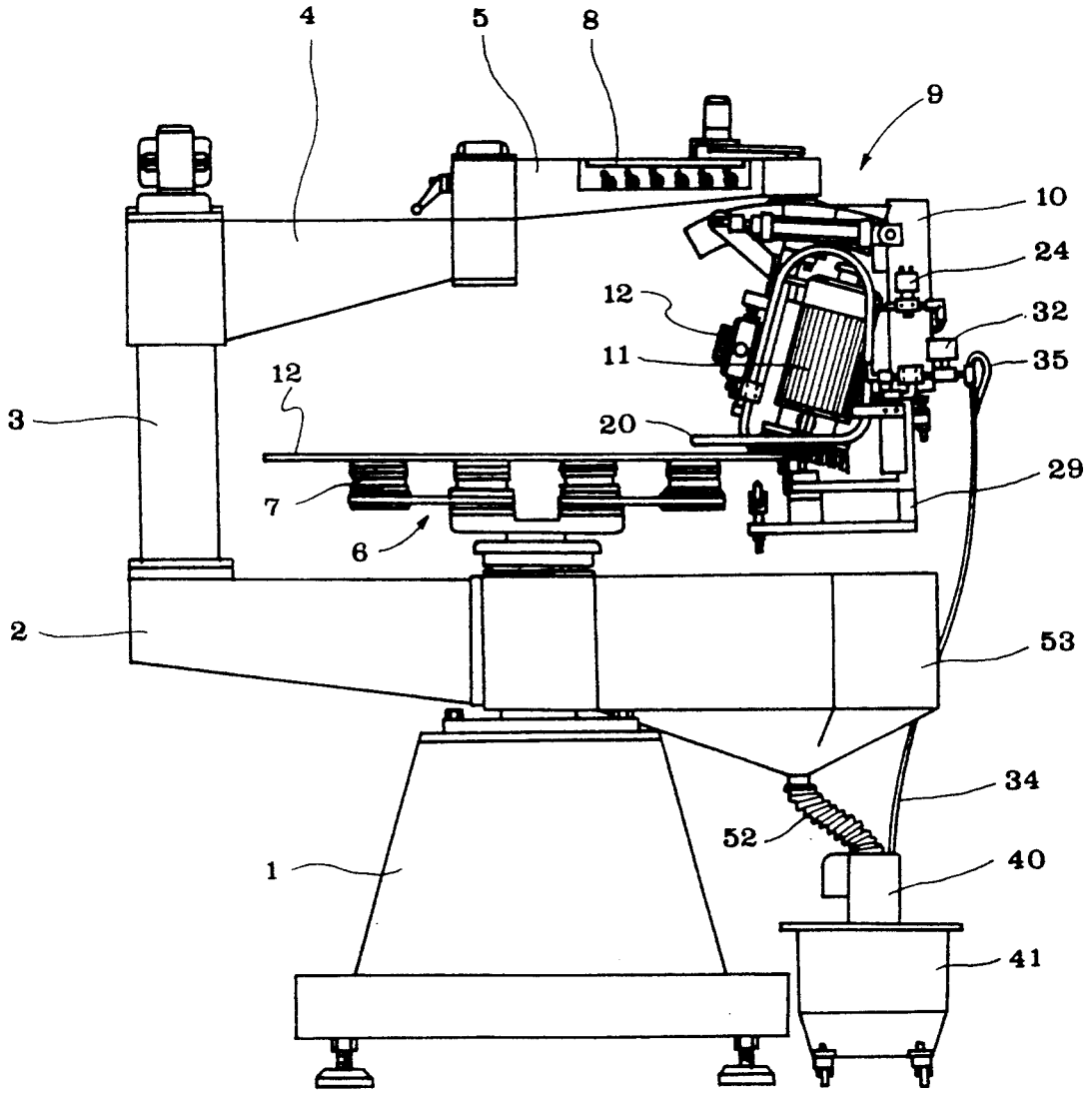
FIG. 1 is a side elevational view of the glass plate chamfering machine according to the present invention.

FIG. 1 is a side elevational view of the chamfering machine of the present invention, which is capable of performing a chamfering and a grinding on glass plates.

The overall contour of the chamfering machine of FIG. 1 is similar to that of Korean Utility Model Registration No. 57464, and that of Korean Utility Model Application No. 88-22093, both of which were filed by the present applicant.

As shown in this drawing, a rotary table 6 is mounted on the top of a base body 1, and a horizontal beam 2 extends from under the rotary table 6, while a vertical pole 3 extends uprightly from the outer end of the horizontal beam 2. Further, a first juncture beam 4 extends from the top of the vertical pole 3, and a second juncture beam 5 extends from the leading end of the first juncture beam 4. A four-direction adjusting means 9 is suspended from the free end of the second juncture beam 5, and the above components are the features of the usual chamfering machine The characteristic feature lies in the device which is suspended from the four direction adjusting means 9.

Figure 2:
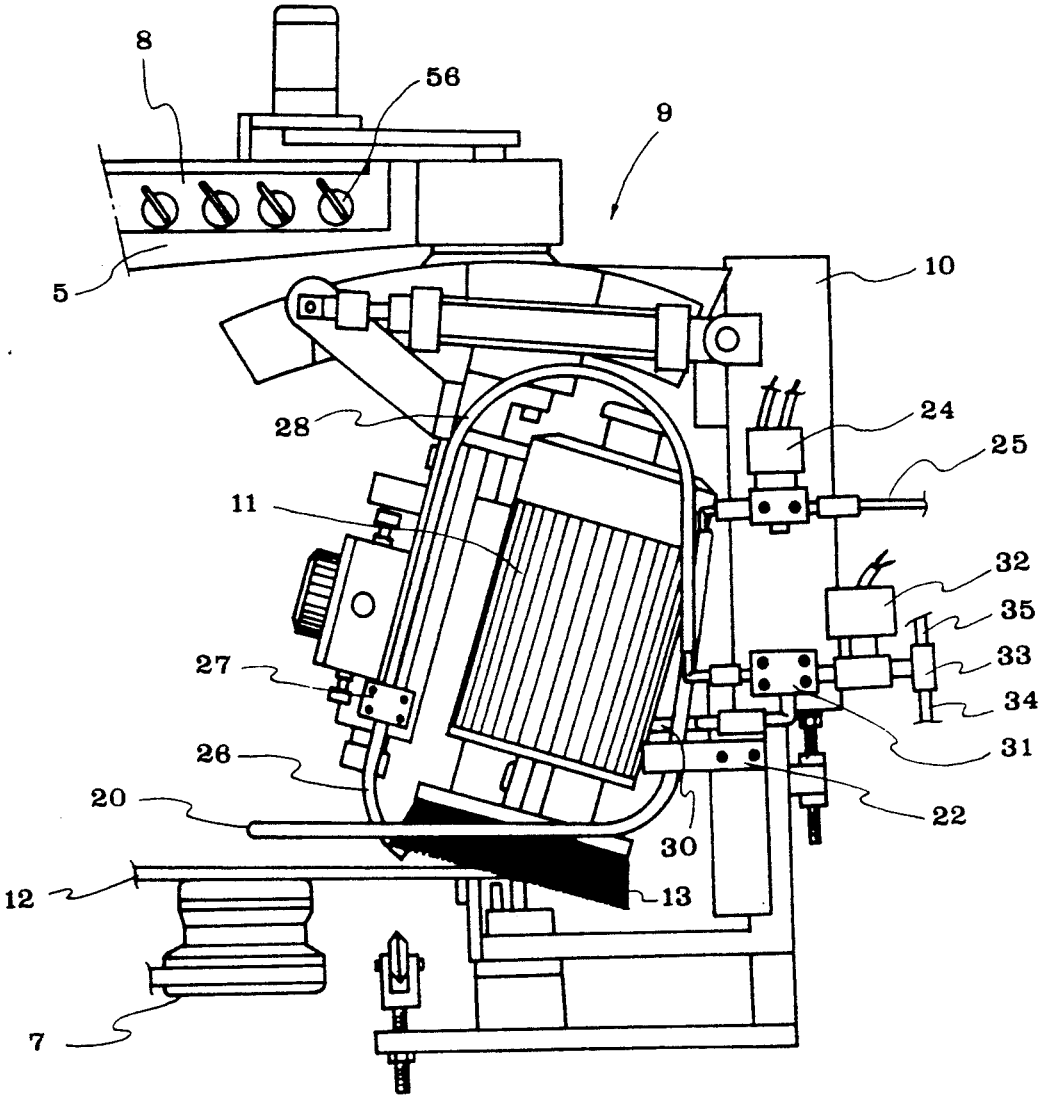
FIG. 2 illustrates the critical portions of the chamfering machine of FIG. 1.
Figure 3:
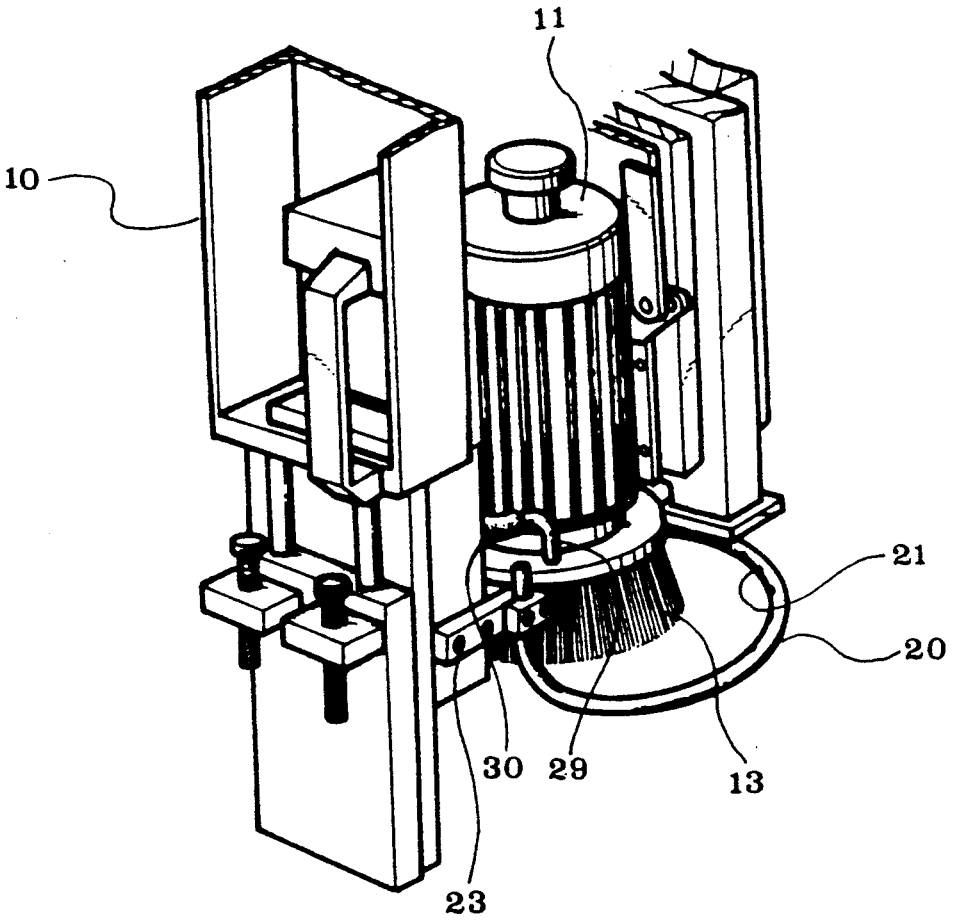
FIG. 3 illustrates the same portion as that of FIG. 2, but viewed in the opposite direction.

That is, as shown in FIGS. 1 and 2, a semi-circular pressure air spout array 20 is installed around a chamfering fluid spray prevention brush 13 of a wheel motor 11. The spout array 20 is secured in such a manner that one end of it is secured to one side of a vertical supporting pole 10 by means of a bracket 23 as shown in FIG. 3, and that the other end of the spout array 20 is secured to the other side of the vertical supporting pole 10 by means of a bracket 22 as shown in FIG. 2. Further, The spout array 20 is connected to an electronic valve 24 which is attached on the upper portion of the vertical supporting pole 10, while the electronic valve 24 is connected to a pressure air supplying hose 25. The pressure air spout array 20 includes a plurality of air spout holes 21 which are formed in an inclination of 30° relative to a glass plate 12.

Below the electronic vale 24, there are installed another electronic valve 32 and a branch device 31, to the latter of which is connected supply hoses 28 and 30. Further, a connecting device 27 connects a supply nozzle 26 of a height adjusting means 12 and a supply nozzle 29 of the spray preventing brush 13.

The electronic valve 32 is connected through a connecting tube 33 to a grinding fluid supplying hose 35 and to a chamfering fluid supplying hose 34 which are connected to a grinding fluid circulating pump 36 and a chamfering fluid circulating pump 40 respectively, these pumps being to be described further below.

A fluid guiding vessel 53 is attached on the horizontal beam which is disposed below the rotary table 6, and the vessel 53 is disposed below the pressure air spout array 20, and is connected to a recovery hose 52.

Figure 4:
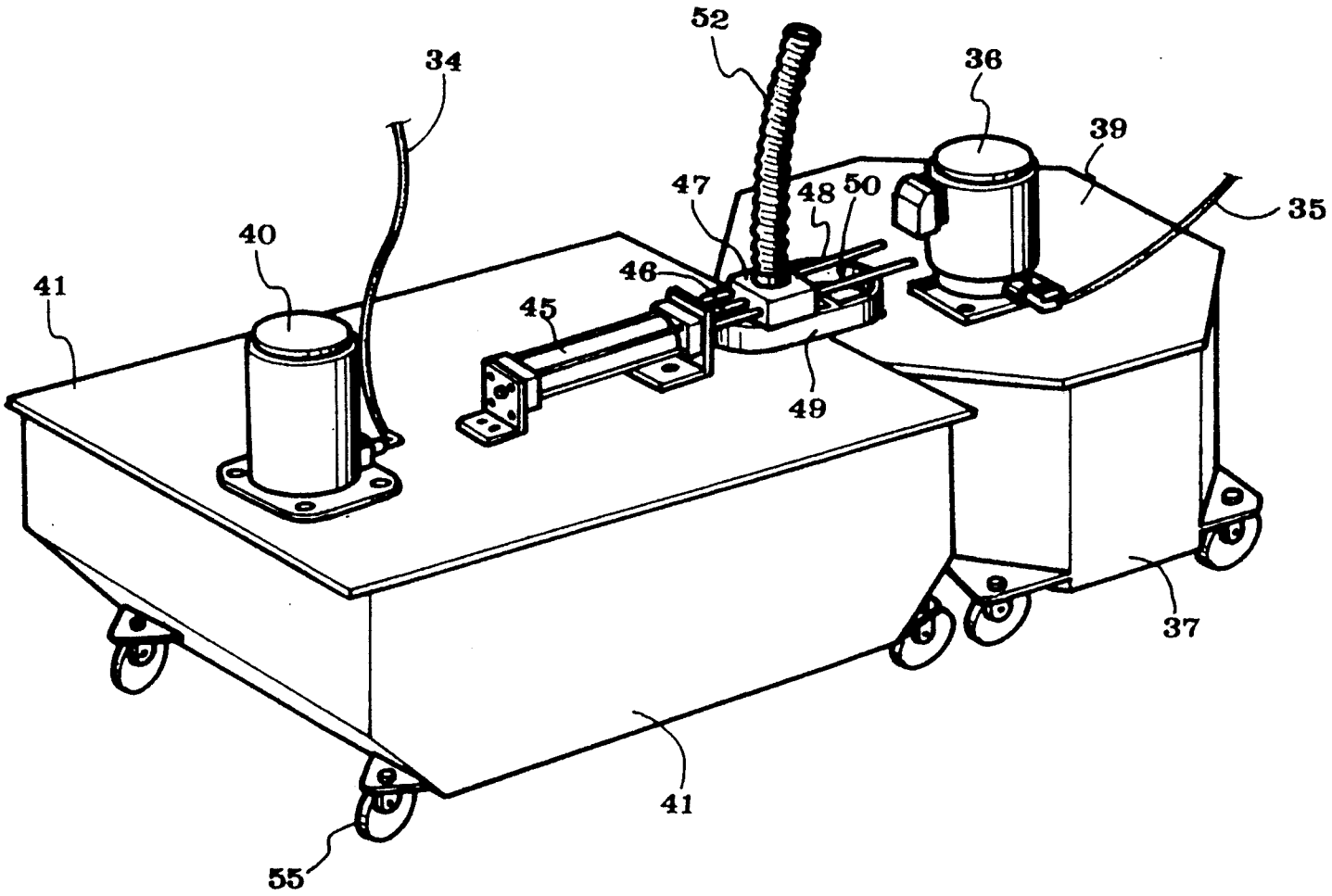
FIG. 4 illustrate the chamfering fluid tank and the grinding fluid tank according to the present invention.

As shown in FIGS. 1 and 4, a chamfering fluid tank 41 and a grinding fluid tank 37 are installed below the fluid guiding vessel 53, and the two tanks are covered with lids 39 and 41'. Further, the two tanks are provided with rolling wheels 55, while a partition wall 42 is installed within the chamfering fluid tank 41.

The grinding fluid circulating pump 36 and the chamfering fluid circulating pump 40 are installed on the lids 39 and 41', while a grinding fluid supplying hose 35 and a chamfering fluid supplying hose 34 extend respectively from the two pumps 36 and 40", At the boundary between the chamfering fluid tank 41 and the grinding fluid tank 37, there are formed recovery holes 50 and 51, with a basin 49 being formed around the recovery holes 50 and 51.

A pneumatic cylinder 45 is attached at a side of the recovery hole 51, and a rod 46 of the pneumatic cylinder 45 is connected to the end portion of the recovery hose 52 which is connected to the fluid guiding vessel 53, and which is secured to a carrying device 47. The carrying device 47 moves by being actuated by two rods 48.

Figure 8:
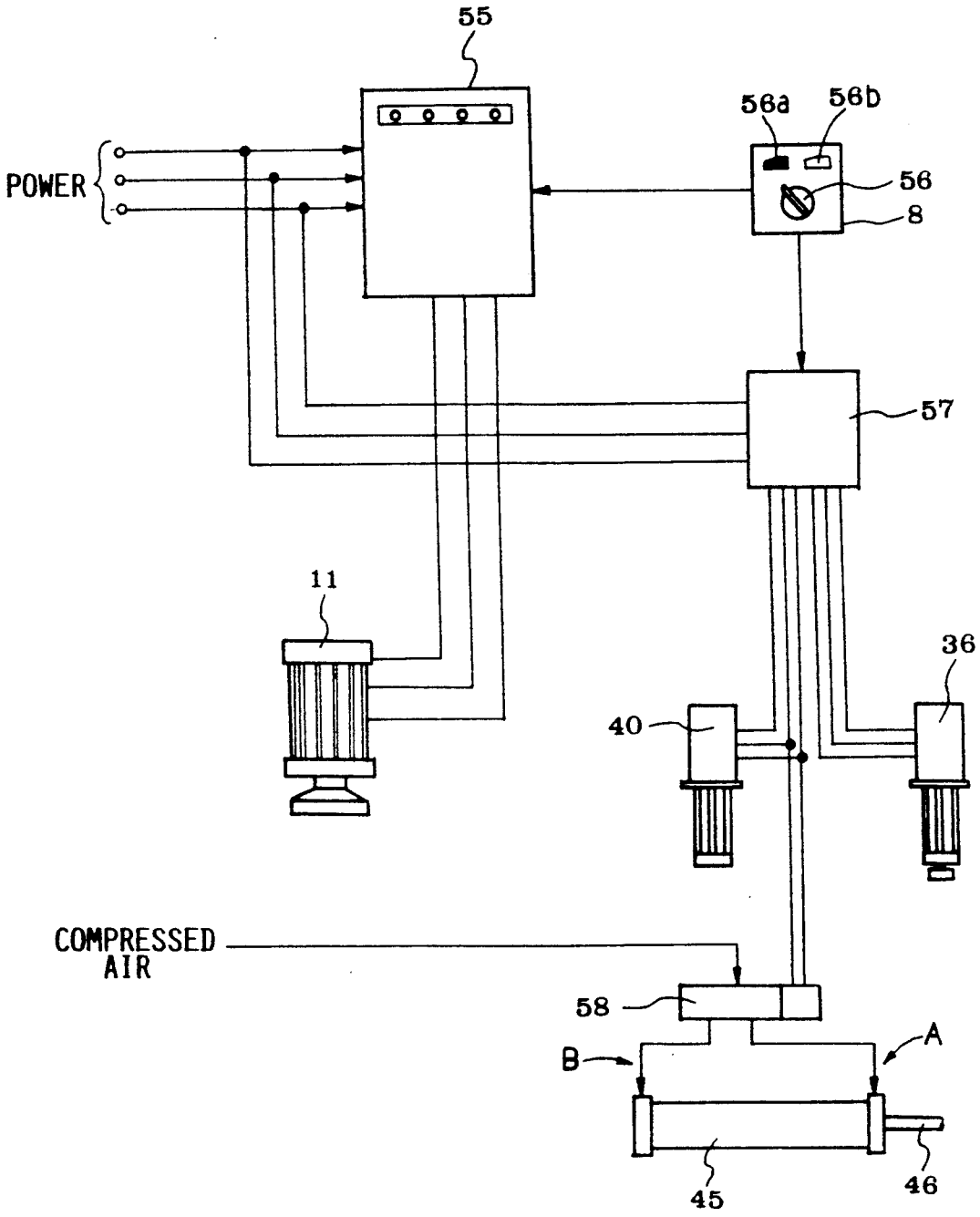
FIG. 8 is a block diagram showing the operation of the chamfering machine according to the present invention.

The glass plate chamfering machine according to the present invention can be shifted between a chamfering mode and a grinding mode by manipulating a selecting switch 56 of a switch box 8 which is attached on the second juncture beam 5 as shown in FIG. 8. For example, if the selecting switch 56 is switched over to a chamfering mode, an inverter 55 adjusts the revolution speed of the wheel motor 11 to the chamfering speed. Further, an electronic switch 57 supplies electric currents to both the chamfering fluid circulating pump 40 and to a solenoid valve 58, so that the chamfering fluid should be supplied. Further, the pneumatic cylinder 45 places the recovery hose 52 to the recovery hole 51 of the chamfering fluid tank 41.

On the other hand, if the selecting switch 56 is switched over to the grinding mode, the inverter 55 adjusts the revolution speed of the wheel motor 11 to the grinding speed, and the electronic switch 57 supplies an electric current to the grinding fluid circulating pump 36, thereby supplying the grinding fluid.

The glass plate chamfering machine constituted as above according to the present invention will now be described as to its operation.

First, a glass plate 12 is mounted upon the rotary table 6, and a chamfering wheel is installed on the wheel motor 11. Then if the selecting switch 56 of the switch box 8 is switched over to a chamfering mode 56*a*, the electronic switch 57 (installed within a control box) supplies currents to both the chamfering fluid circulating pump 40 and to the solenoid valve 58. Consequently, the chamfering fluid circulating pump 40 is driven, so that the chamfering fluid 43 of the chamfering fluid tank 41 should be sent through the chamfering fluid supplying hose 34. Then the compressed air is introduced into the pneumatic cylinder in the direction of A, so that the rod 46 of the cylinder 45 should be withdrawn, and that the recovery hose 52 connected to the fluid guiding vessel 53 should be placed on the recovery hole 51 of the chamfering fluid tank 41. Meanwhile, the inverter 55 adjusts the revolution speed of the wheel motor 11 to be suitable for the chamfering, i.e., 4500 rpm.

In this state, if a start switch (disposed in the switch box 8) is turned on, the inverter 55 lowers the wheel motor 11 so as for it to be contacted with the edge of the glass plate 12. Further, currents are supplied to the electronic valves 24 and 32 which are attached on the vertical supporting pole 10 of the four-direction adjusting means 9, thereby opening the electronic valves 24 and 32. Then a compressed air (produced by a compressor not illustrated) which is supplied through the compressed air hose 25 is sent through the electronic valve 24 to the semi-circular pressure air spout array 20, so that pressure air should be spouted through spout holes 21 in the direction of 30° relative to the glass plate.

Meanwhile, the chamfering fluid 43 passes from the chamfering fluid supplying hose 34 of the chamfering fluid tank 41 through the electronic valve 32 by the action of the chamfering fluid circulating pump 40. The chamfering fluid 43 further passes through the branching device 31 to be divided into the supply tubes 28 and 30, and to be sent to the injecting nozzles 26 and 29 which are fixedly installed at the opposite sides of the wheel motor 11.

Thus, during the time when the chamfering operation is being carried out, the chamfering fluid 43 and fine glass particles are pushed toward the inner portion of the glass plate owing to the centrifugal force exerted by the revolving chamfering wheel. Thus the chamfering fluid and the glass particles tend to be spread on the whole surface of the glass plate, and however, according to the present invention, the chamfering fluid and the glass particles are pushed toward the fluid guiding vessel 53 by the action of the pressure air spout array 20.

Figure 6:
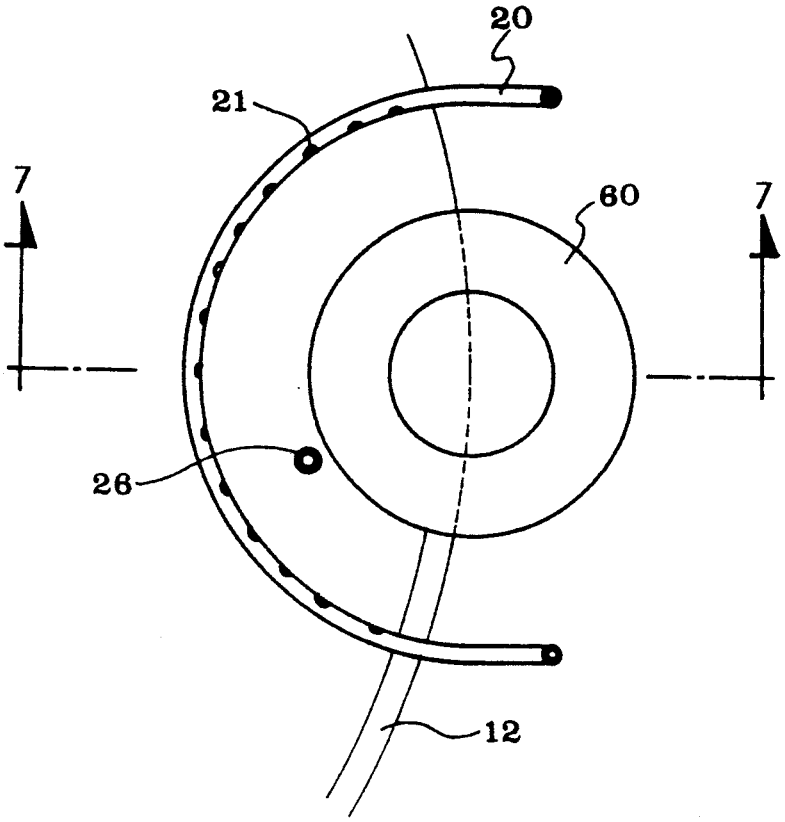
FIG. 6 illustrates the semi-circular pressure air spout array installed around the wheel motor according to the present invention.
Figure 7:
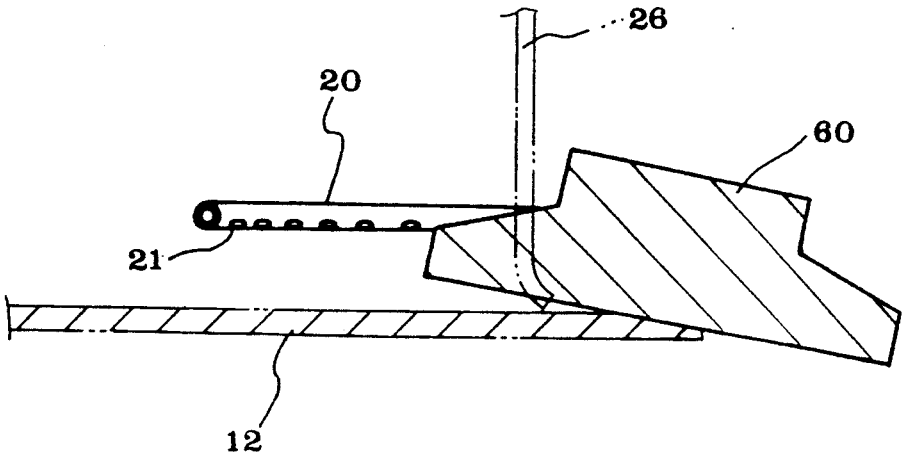
FIG. 7 is a sectional view taken along the line A—A of FIG. 6.

That is, the pressure air is sprayed through the spout holes 21 of the pressure air spout array 20 which is directed at an angle of 30° relative to the glass plate as shown in FIGS. 6 and 7. Thus, the chamfering fluid and the glass particles which tend to be directed toward the inner portion of the glass plate are focused to within the spray prevention brush 13 and the chamfering wheel 60. Further, when the glass plate revolves to be chamfered, the chamfering fluid and the glass particles are collected in a circular form to be guided to the fluid guiding vessel 53, because the pressure air spout array 20 is semi-circular.

Meanwhile, the chamfering fluid which is dropped into the fluid guiding vessel 53 during the chamfering operation passes through the recovery tube 52 and through the recovery hole 51 into the chamfering fluid tank 41. The chamfering fluid tank 41 includes a partition wall 42, so that the glass particles are made to be sunk to the bottom of the partition 42*a*, and that the light chamfering fluid can overflow to the partition 42*b*. The chamfering fluid which is returned to the partition 42*b* is recirculated to the spray nozzle 26 by the action of the chamfering fluid circulating pump 40.

When the chamfering operation for a glass plate is completed, all the power supplies are disconnected, and the electronic valves 24 and 32 are turned off. Further, the supplies of the compressed air and the chamfering fluid are stopped, and the wheel motor 11 is lifted up.

In this condition, if the chamfered glass plate is to be ground, the chamfering wheel of the wheel motor 11 is replaced with a grinding wheel, and the selecting switch 56 is switched over from the chamfering mode 56*a* to the grinding mode 56*b*.

Figure 5:
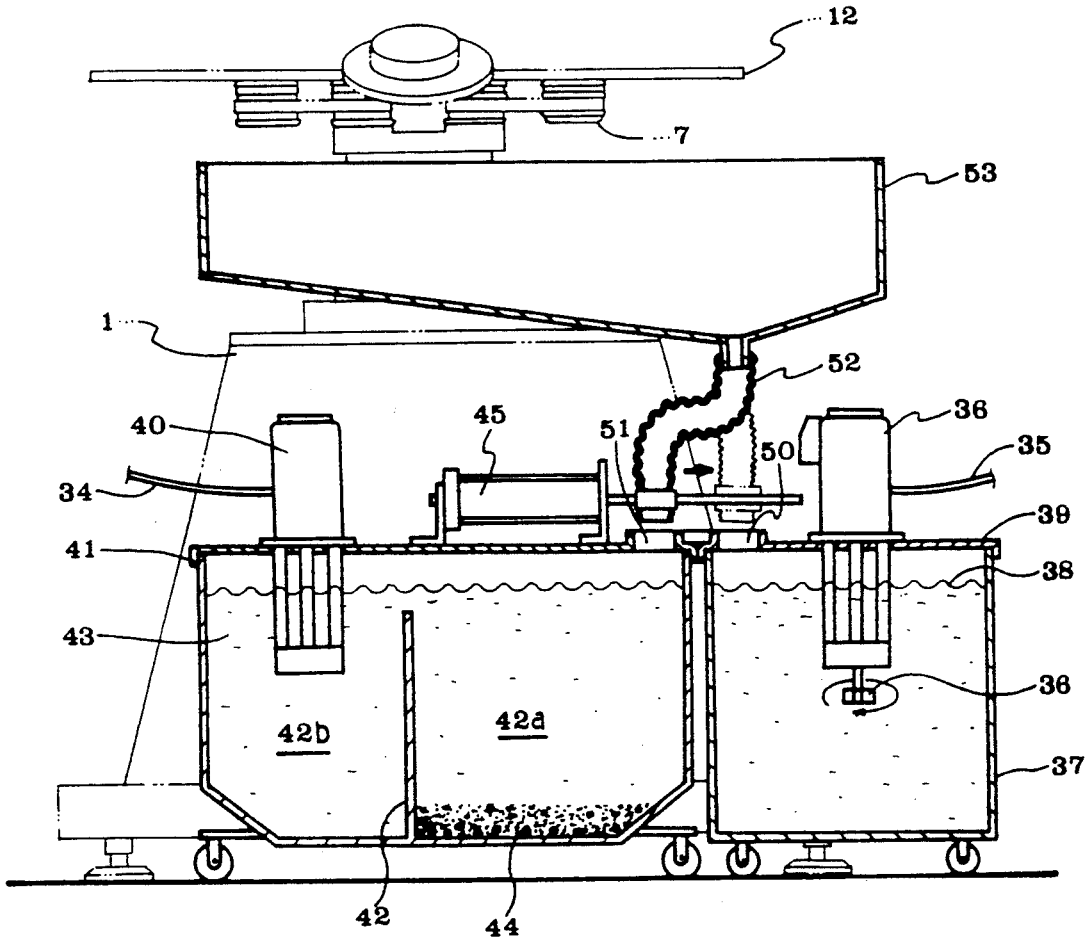
FIG. 5 is a sectional view of the tanks of FIG. 4.

Then this time, the electronic switch 57 shifts the power to the grinding fluid circulating pump 36 to drive it. Consequently, the grinding fluid 38 of the grinding fluid tank 37 is sent through the grinding fluid supplying hose 35. Under this condition, the power is disconnected from the solenoid valve 58, so that the compressed air is introduced into the pneumatic cylinder 45 in the direction of B. Consequently, the rod 46 of the cylinder is pushed out, resulting in that the recovery tube 52 is placed on the recovery hole 50 of the grinding fluid tank 37 as shown in dotted lines in FIG. 5.

In this state, if the start switch is turned on, the inverter 55 lowers the wheel motor with a grinding wheel attached thereon Consequently, the grinding wheel is contacted with the edge of the glass plate, and the grinding wheel is driven at 2000 rpm. At the same time, currents are supplied to both of the electronic valves 24 and 32 which are attached on the vertical supporting pole 10, thereby opening the electronic valves 24 and 32.

Then the compressed air which is supplied from the compressed air supplying hose 25 passes through the electronic valve 24 to be delivered to the compressed air spout array 20, so that the compressed air should be spouted through the spraying nozzle 21 toward the grinding wheel.

Meanwhile, the grinding fluid 38 is sent from the grinding fluid tank 37 through the grinding fluid supplying hose 35 and through the electronic valve 32 by the action of the grinding fluid circulating pump 36. Then the stream of the grinding fluid 38 is split at the branching device 31 to be sent to the supplying nozzles 26 and 29 through which the grinding fluid 38 is sprayed.

During the proceeding of the grinding operation in this way, the grinding fluid which are delivered through the supplying nozzles 26 and 29 to the grinding portion is pushed toward the inner portion of the glass plate owing to the centrifugal force of the revolving grinding wheel, thereby tending to be spread on the whole area of the glass plate. However, in the same way as in the case of the chamfering operation, the used grinding fluid cannot depart from the inside of the spray prevention brush 13 owing to the spouting air of the pressure air spouting array 20, but pushed into the fluid guiding vessel 53. The grinding fluid which is dropped into the fluid guiding vessel 53 is recovered through the recovery hose 52 and the recovery hole 50 into the grinding fluid tank 38. Then the recovered grinding fluid is continuously circulated by being sent to the supplying nozzle 26 by the action of the grinding fluid circulating pump 36. An eddy current generating vane 36 is installed below the grinding fluid circulating pump 36, so that the grinding agent should not sink down to the bottom of the tank. In this way, the grinding will be completed.

According to the present invention, the chamfering and grinding operations can be performed with one unit of machine, and therefore, the facility cost is reduced, as well as improving the work efficiency.

What is claimed is:

1. A glass plate chamfering machine capable of chamfering and grinding successively, including: a base body 1; a horizontal beam 2 extending horizontally from the top of said base body 1; a vertical pole 3 upstanding from the outer end of said horizontal beam 2; a first juncture beam 4 extending horizontally from the top of said vertical pole 3; a second juncture beam 5 connected to the end of said first juncture beam 4; a four-direction adjusting means 9 and a wheel motor 11 suspending from the free end of said second juncture beam 5; supplying nozzles 26 and 29 installed together with an electronic valve 32 at the opposite sides of said wheel motor 11; and a fluid guiding vessel 53 installed below a rotary table 6, the chamfering machine further comprising:

a pressure air spout array 20 having a plurality of spouting holes 21 and installed around a spray prevention brush 13, said pressure air spout array 20 being connected through an electronic valve 24 to a compressed air supplying hose 25;

a chamfering fluid tank 41 and a grinding fluid tank 37 disposed below said fluid guiding vessel 53;

a chamfering fluid circulating pump 40 and a grinding fluid circulating pump 36 installed on the tops of said chamfering fluid tank 41 and said grinding fluid tank 37 respectively;

recovery holes 50 and 51 disposed at the boundary between said chamfering fluid tank 41 and said grinding fluid tank 37;

a pneumatic cylinder 45 installed at the side of said recovery hole 51, with the rod 46 of said pneumatic cylinder 45 being connected to a recovery hose 52 so as for said rod 46 to place said recovery hose 52 to either said recovery hole 50 or said recovery hole 51; and an inverter 55 for controlling the revolution speed of said wheel motor 11 upon manipulating a selecting switch 56, said inverter 55 being electrically connected to a electronic switch 57 for controlling said chamfering fluid circulating pump 40, a solenoid valve 58 and said grinding fluid circulating pump 36, and said selecting switch 56 being manipulable to a chamfering mode and a grinding mode.

2. The glass plate chamfering machine capable of chamfering and grinding successively as claimed in claim 1, wherein said pressure air spout array 20 is attached on a vertical supporting pole 10 by means of brackets 22 and 23, said array 20 having the shape of a semi-circle.

3. The glass plate chamfering machine capable of chamfering and grinding successively as claimed in claim 1, wherein said spouting holes 21 of said pressure air spout array 20 is inclined so as for the compressed air to be spouted toward said spray prevention brush 13.

4. The glass plate chamfering machine capable of chamfering and grinding successively as claimed in claim 1, wherein, upon shifting the operating mode from a chamfering mode to a grinding mode or vice versa, said inverter 55 adjusts the revolution speed of said wheel motor 11, and an electronic switch 57 selectively activates said chambering fluid circulating pump 40, said solenoid valve 58 and said grinding fluid circulating pump 36.

* * * * *